US006253660B1

(12) United States Patent
Noda et al.

(10) Patent No.: US 6,253,660 B1
(45) Date of Patent: Jul. 3, 2001

(54) RODLESS CYLINDER

(75) Inventors: Mitsuo Noda, Ichinomiya; Tuyoshi Yonezawa, Nakashima-gun, both of (JP)

(73) Assignee: Howa Machinery, Ltd., Nagoya (JP)

( * ) Notice: Subject to any disclaimer, the term of this patent is extended or adjusted under 35 U.S.C. 154(b) by 0 days.

(21) Appl. No.: 09/494,764

(22) Filed: Jan. 31, 2000

(30) Foreign Application Priority Data

Feb. 22, 1999 (JP) ..... 11-043147

(51) Int. Cl.[7] ..... F15B 15/14
(52) U.S. Cl. ..... 92/88
(58) Field of Search ..... 92/88

(56) References Cited

U.S. PATENT DOCUMENTS

| | | | |
|---|---|---|---|
| 3,820,446 | 6/1974 | Granbom et al. | 92/88 |
| 3,893,378 | 7/1975 | Hewitt | 92/88 |
| 5,473,971 | 12/1995 | Takeuchi et al. | 92/88 |
| 5,988,042 * | 11/1999 | Lamie | 92/88 |

FOREIGN PATENT DOCUMENTS

| | | |
|---|---|---|
| 0 884 485 A2 | 12/1998 | (EP) . |
| 62-81702 | 5/1987 | (JP) . |
| 5-106611 | 4/1993 | (JP) . |
| 7-259807 | 10/1995 | (JP) . |
| 2512354 | 4/1996 | (JP) . |
| 11-13711 | 1/1999 | (JP) . |

* cited by examiner

*Primary Examiner*—John E. Ryznic
(74) *Attorney, Agent, or Firm*—Finnegan, Henderson, Farabow, Garrett & Dunner, L.L.P.

(57) ABSTRACT

An inner seal band having flat surfaces on both sides is used for closing a slit formed on the cylinder tube of a rodless cylinder. An internal moving body is disposed in the cylinder tube and moves along the longitudinal axis of the cylinder tube. The inner seal band passes through a channel groove formed on the bottom face of the internal moving body. Thin plate-like abrasion members made of synthetic resin are adhered on the side walls of the channel groove. The abrasion members contact with the edges of the inner seal band and restricts its movement in the transverse direction. Since the abrasion members are separate members from the side walls of the channel groove, a material different from that of the side walls, such as abrasion resistant material can be used for the guide members. Further, the thickness of the guide members can be selected in accordance with the actual width of the channel groove and the difference in the width of the channel groove due to machining tolerance can be compensated for by using the guide members having appropriate thicknesses.

15 Claims, 12 Drawing Sheets

RODLESS CYLINDER

BACKGROUND OF THE INVENTION

1. Field of the Invention

The present invention relates to a rodless cylinder having a cylinder tube provided with an internal moving body disposed in the cylinder tube and moving along the axis of the tube and an external moving body disposed outside the cylinder tube and driven by the internal moving body through an axially extending slit formed on the wall of the cylinder tube. More specifically, the present invention relates to an inner seal band, disposed inside the cylinder tube, which seals the inner opening of the slit on the cylinder wall.

2. Description of the Related Art

A rodless cylinder which has an external moving body moving axially within a cylinder tube and an external moving body driven by the internal moving body through an axially extending slit on the wall of the cylinder tube is known in the art. A rodless cylinder of this type uses an inner seal band disposed inside the cylinder tube and extending along the slit on the cylinder wall in order to seal the inner opening of the slit. In some types of rodless cylinders, inner seal bands having flat faces on both sides are used.

Rodless cylinders using inner seal bands having flat faces are disclosed in various publications.

For example;

(A) Japanese Unexamined Utility Model Publication (Kokai) No. 62-81702, U.S. Pat. No. 3,820,446 and Japanese Unexamined Patent Publication (Kokai) No. 11-13711 disclose rodless cylinders having inner seal bands in the form of a flat metal band. In these publications, the inner seal band of the rodless cylinder is fixed to end members at both ends of the inner seal band. The end members (for example, end caps) are disposed at both ends of the cylinder tube of the rodless cylinder in order to close the open ends of the cylinder tube. The transverse movement of the inner seal band (the movement in the direction of the width of the inner seal band) is restricted by the connection with the end members at both ends of the inner seal band. At the portion between both ends, the inner seal band passes through a band guide recess formed on the internal moving body in the axial direction. However, in these publications, relatively large transverse clearances are formed between both side walls of the recess and the side edges of the inner seal band.

(B) U.S. Pat. No. 3,893,378 discloses a rodless cylinder having an inner seal band which has flat faces. However, the inner seal band in this publication has a width substantially the same as the width of the band guide recess of the internal moving body. In this publication, since both side edges directly contact the side walls of the band guide recess, the transverse movement of the inner seal band is restricted by the band guide recess.

(C) On the other hand, Japanese Unexamined Patent Publication (Kokai) No. 7-259807 and Japanese Patent No. 2512354 disclose inner seal bands of different type. The inner seal bands in these publications have a cross-section shape which allows the inner seal band to fit into the slit of the cylinder tube wall or fitting grooves running parallel to the slit. Therefore, the transverse movement of the inner seal band is restricted along the entire length thereof.

Though the displacement of the inner seal band relative to the slit in the transverse direction hardly occurs in the publications (C), the inner seal bands having flat faces (i.e., the inner seal bands having a flat rectangular cross section shape) such as those disclosed in the publications (A) and (B) are liable to displace in the transverse direction with regard to the slit.

For example, the seal band in the publication (A) is restricted at both ends thereof in the transverse direction. However, since relatively large clearances remain between the side edges and the side walls of the band guide recess of the internal moving body, the middle portion of the inner seal band is not sufficiently restricted in the transverse direction. Therefore, the inner seal band tends to displace in the direction transverse to the slit. Especially, this is true when the stroke of the rodless cylinder is long, or the rodless cylinder is placed in the position where the slit faces a horizontal direction (i.e., when the width of the faces of the inner seal band is oriented to the vertical direction).

When the inner seal band shifts in the transverse direction relative to the slit of the cylinder tube, the seal performance of the inner seal band deteriorates and pressure fluid in the cylinder tube leaks from the slit. This causes so-called "stick and slip phenomena" of the rodless cylinder in which jagged movements of the inner and external moving bodies occur.

On the other hand, even though it uses the inner seal band having flat faces, the transverse displacement of the inner seal band is not likely occur in the rodless cylinders in the publications (B) since the transverse movement of the middle portion of the inner seal band is restricted by the contacts between the side edges of the inner seal band and the side walls of the band guide recess of the internal moving body. However, in the publication (B), the inner seal band is guided by the direct contact between the side edges of the inner seal band and the side walls of the seal band guide recess. Therefore, the width of the seal band must exactly match the width of the seal band guide recess of the internal moving body. This requires precise machining of the inner seal band and the side walls of the recess. Further, since the inner seal band and the side walls of the recess of the seal band guide directly contact each other, the problems of abrasion may occur. Since the internal moving body is a solid one-piece construction, it is difficult to use an abrasion resistant material only for the side walls of the recess. Further, if a material such as aluminum or steel is used for the internal moving body, dust is generated by the wear of the side walls and the seal band. In this case, dust generated by the wear attaches to the surface of the seal band. This causes deterioration of seal performance of the seal band and a shortening of the service life of the seal band.

Though the problems related to the transverse displacement of the inner seal band do not occur in the inner seal band of the publication (C), the cross section shape of the inner seal band and the slit or the guide grooves must be precisely machined. This requires an additional machining cost.

SUMMARY OF THE INVENTION

In view of the problems in the related art as set forth above, one of the objects of the present invention is to provide a rodless cylinder in which the transverse movement of the inner seal band is restricted by the seal band guide recess of the internal moving body, and which does not require close tolerances in the machining of the inner seal band and the side walls.

Another object of the present invention is to provide a rodless cylinder which allows use of a material suitable for sliding contact with the inner seal band only in the area of the side wall surfaces of the recess contacting the inner seal band.

Another object of the present invention is to provide a rodless cylinder in which dust, due to wear of the side walls and inner seal band, is not generated.

One or more of the objects as set forth above are achieved by a rodless cylinder according to the present invention, comprising a tube provided with a bore and a slit which penetrates the wall of the tube and extends in parallel to the longitudinal axis of the tube, an internal moving body disposed in the bore of the tube and movable therein along the direction of the longitudinal axis of the tube, an external moving body disposed outside of the tube and coupled to the piston by a driving member extending through the slit so that the external moving body moves with the internal moving body along the slit, and an inner seal band having flat faces on both sides and extending along the slit to cover the slit from the inside of the bore, both longitudinal end portions of said inner seal band being restrained in movement with respect to the tube, and the middle portion thereof passing through a channel groove formed on the internal moving body wherein separate abrasion members are provided on the side walls of the channel groove in such a manner that the movement of the inner seal band in the transverse direction is restrained by the restrained ends of the inner seal band and the contact between the longitudinal edges of the inner seal band and said abrasion members.

According to the present invention, since the abrasion members which contact the edges of the inner seal band are formed as separate members from the side walls of the channel groove, a material separate from that of the side walls, for example, an abrasion resistant material can be used for the abrasion members. Further, since the thickness of the abrasion members can be selected in accordance with the width of the channel groove, the difference in the width of the channel groove due to the machining tolerance can be compensated for by selecting a suitable thickness of the abrasion members. Therefore, a close tolerance is not required for the machining of the channel groove.

The abrasive members may be made of synthetic resin having a low friction coefficient. If synthetic resin is used for the abrasive members, dust due to the wear is not generated even if the side walls are made of metal and shortening of the service life of the inner seal band does not occur.

BRIEF DESCRIPTION OF THE DRAWINGS

The present invention will be better understood from the description, as set forth hereinafter, with reference to the accompanying drawings in which.

DESCRIPTION OF THE PREFERRED EMBODIMENT

Hereinafter, embodiments of the rodless cylinder according to the present invention will be explained with reference to FIGS. 1 through 16.

Figure 1:
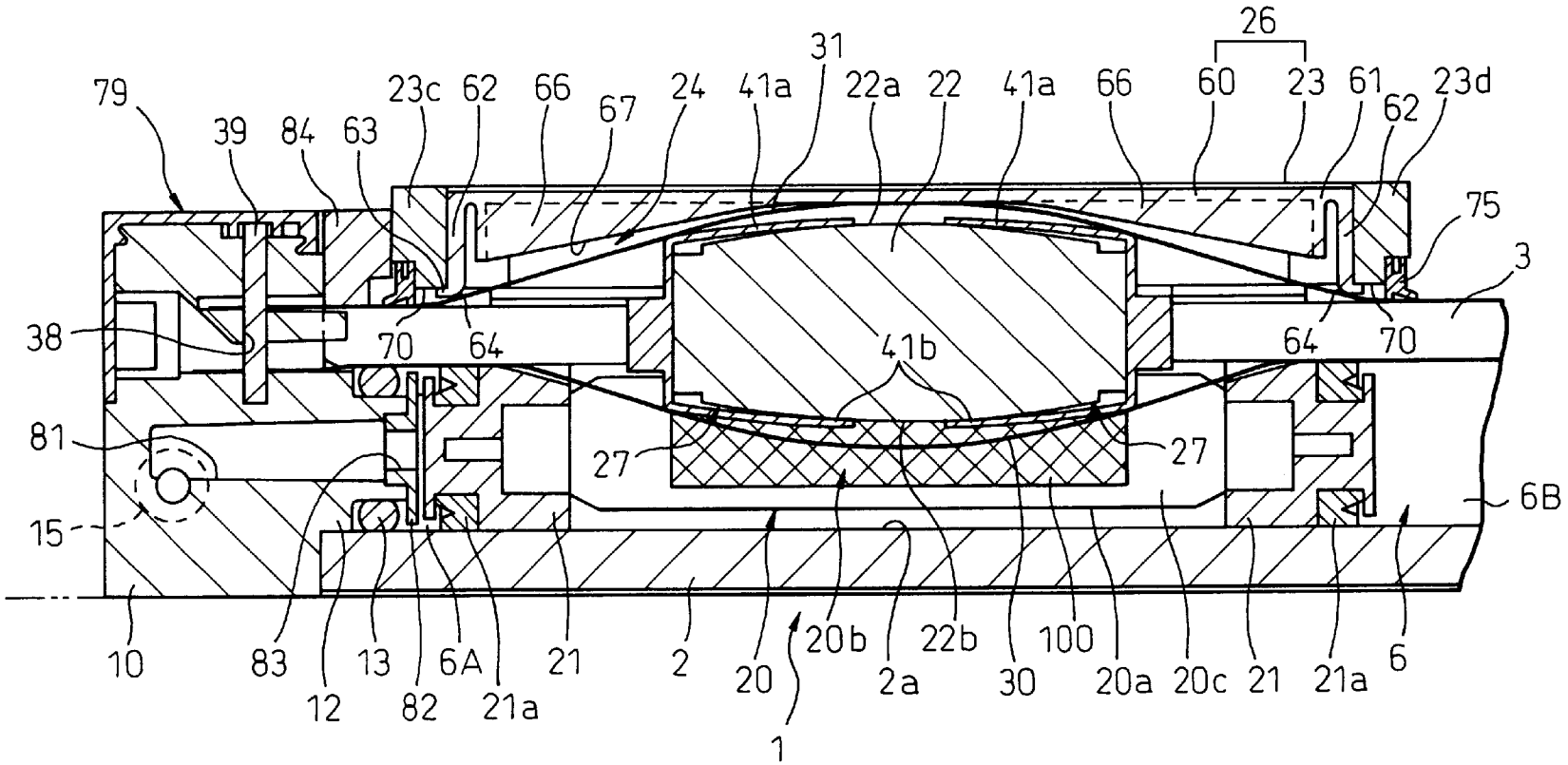
FIG. 1 is a longitudinal section view of a rodless cylinder according to an embodiment of the present invention.
Figure 2:
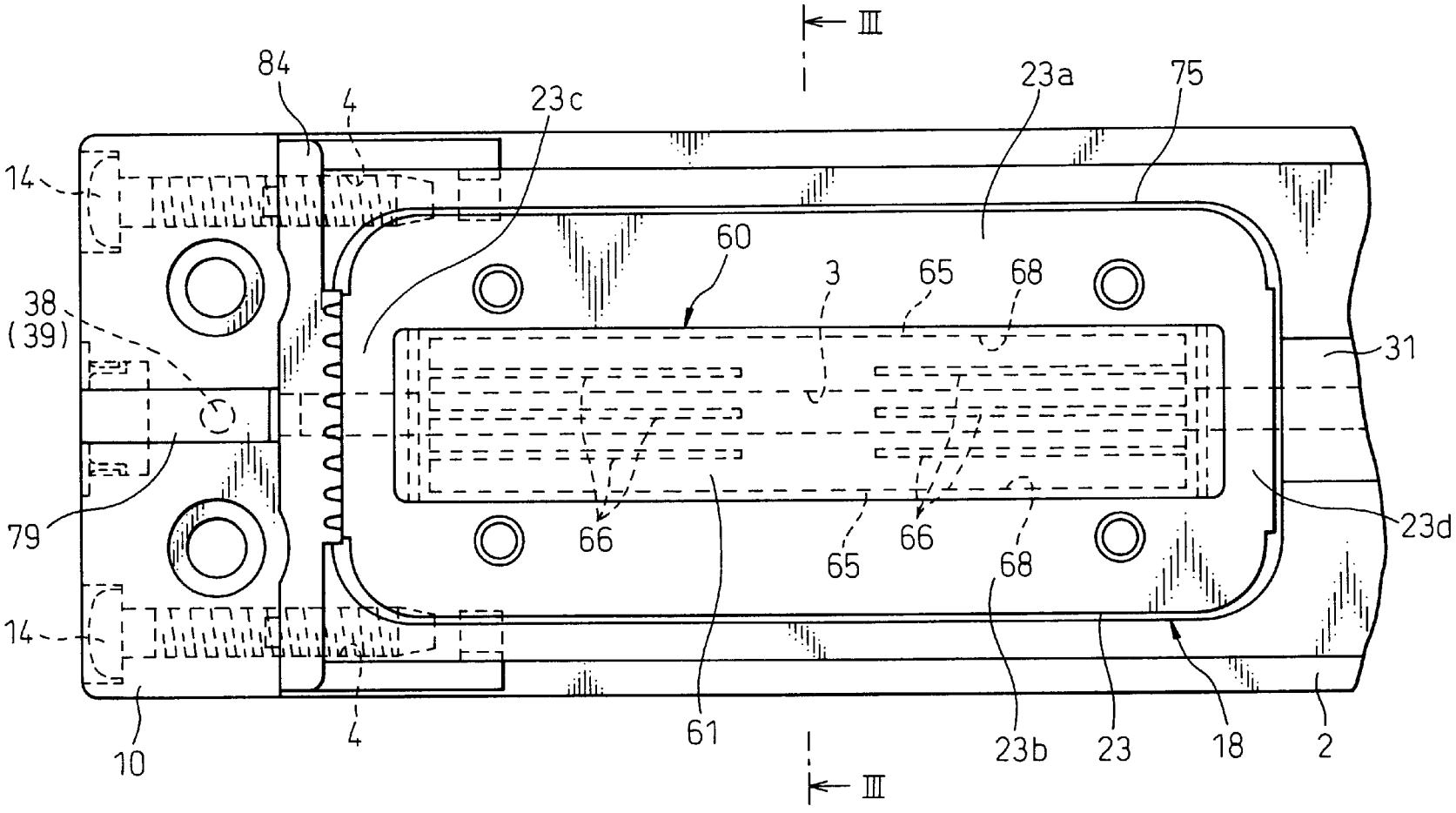
FIG. 2 is a plan view of the rodless cylinder in FIG. 1.
Figure 3:
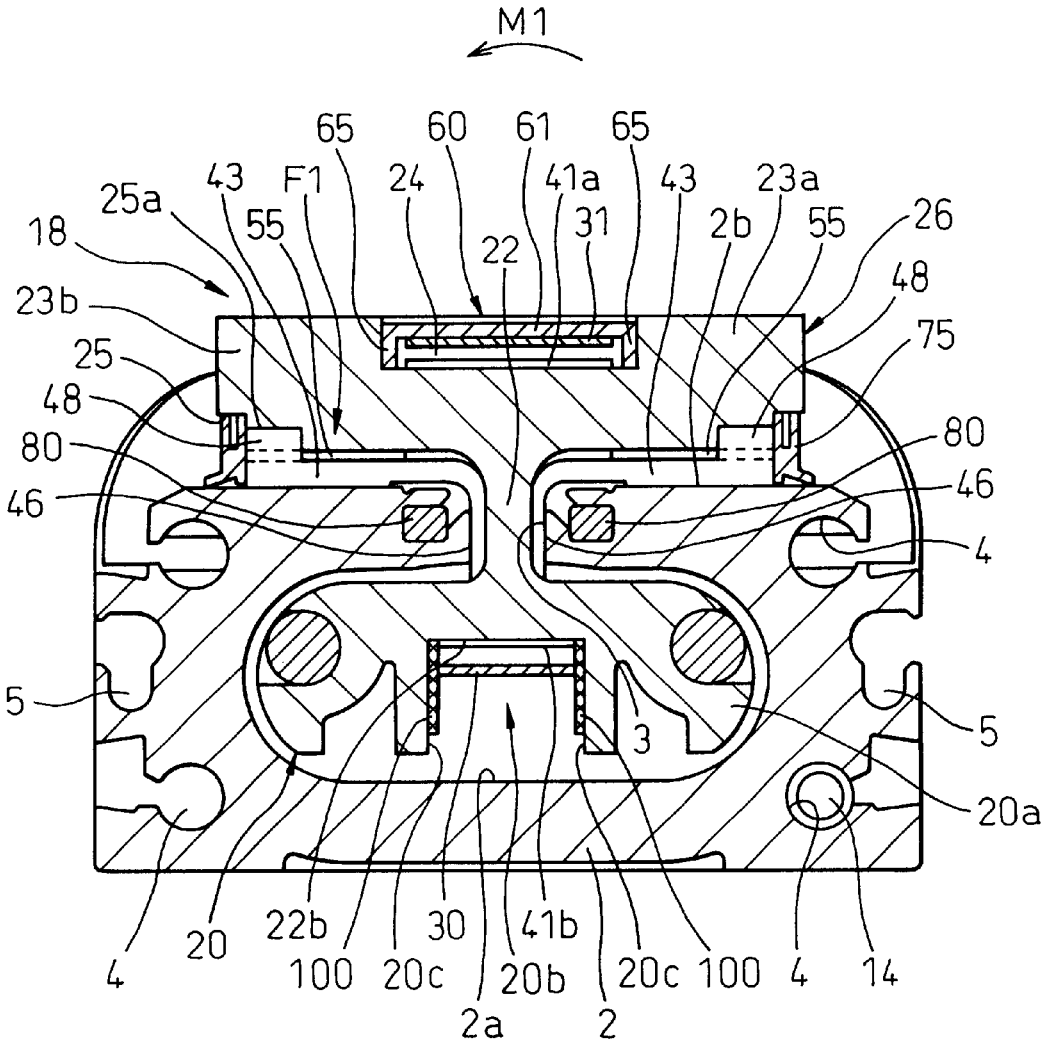
FIG. 3 is a cross sectional view taken along the line III—III in FIG. 2.

FIGS. 1 through 3 illustrate an embodiment of the rodless cylinder according to the present invention.

In FIG. 1, reference numeral 1 designates a rodless cylinder. Numeral 2 is a tube (cylinder tube) of the rodless cylinder 1 which is made of non-magnetic metal such as aluminum alloy and formed by an extrusion or a drawing process. As shown in FIG. 3, the cylinder tube 2 has a non-circular (in this embodiment, an oblong circular) bore 2*a*. A slit opening 3 is formed on the side wall of the cylinder tube along the entire length thereof. On the outer wall of the cylinder tube 2, grooves 4 for attaching end members to the tube 2 and grooves 5 for mounting attachments, such as sensors, are formed along the entire length of the cylinder tube 2.

Both ends of the cylinder tube 2 are closed by end members (end caps) 10 having portions protruding above the upper face of the cylinder tube 2. A cylinder chamber 6 is defined by the wall of the cylinder bore 2*a*and end caps 10 as shown in FIG. 1. As seen from FIG. 1, the end cap 10 has a portion 12 inserted into the cylinder tube 2 with a cylinder gasket 13 intervening therebetween. In this condition, the end cap 10 is secured to the end of the cylinder tube 2 by tightening self-tapping screws 14 into the ends of the grooves 4 (FIG. 2). A self-tapping screw is a screw which cuts a thread in the wall of a screw hole by itself when it is screwed into the screw hole.

The cylinder chamber 6 is divided into a fore cylinder chamber 6A and an aft cylinder chamber 6B by piston ends 21 formed on both longitudinal ends of a piston portion 20*a* (FIG. 1). The piston portion 20*a* forms a part of an internal moving body 20. The piston ends 21 are provided with piston packings 21*a*. On the piston portion 20*a*, a driving member (a piston yoke) 22 for driving an external moving body 26 through the slit 3 is formed integrally at the portion between the piston ends 21. At the end of the driving member 22 outside of the tube 2, a piston mount 23 which is a part of the external moving body 26 is integrally formed. Namely, the piston 20, the driving member 22 and the piston mount 23 form an integral one-piece moving body 18 in this embodiment. This one-piece moving body 18 is formed by die-casting aluminum alloy. The piston mount 23 has left and right side walls 23*a*, 23*b* and fore and aft side walls 23*c*, 23*d*. A recess 20*b* having a predetermined width and extending in the direction along the longitudinal axis of the tube 2 is formed on the bottom face of the piston portion 20*a* at the middle of the width thereof. On the upper face of the piston mount 23, a recess 24 is defined by the right and left side walls 23*a* and 23*b* and the fore and aft side walls 23*c* and 23*d* at the portion above the driving member 22. The recess 24 extends in the direction along the longitudinal axis of the tube 2 from the fore side wall 23*c* to the aft side wall 23*d*. As explained later, the recess 24 on the upper face of the piston mount 23 and the recess 20*b* on the bottom face of the piston portion 20*a* form channel grooves through which an outer seal band and an inner seal band pass. The top face 22*a* of the driving member 22 and the bottom face 22*b* of the seal band guide recess 20*b* are formed as curved surfaces swelling upward and downward, respectively (FIG. 1). Fore and aft ends of the driving member 22 are formed as fitting portions 27 to which band guides for the inner and the outer seal bands 30 and 31 are fitted, as explained later.

Figure 4:
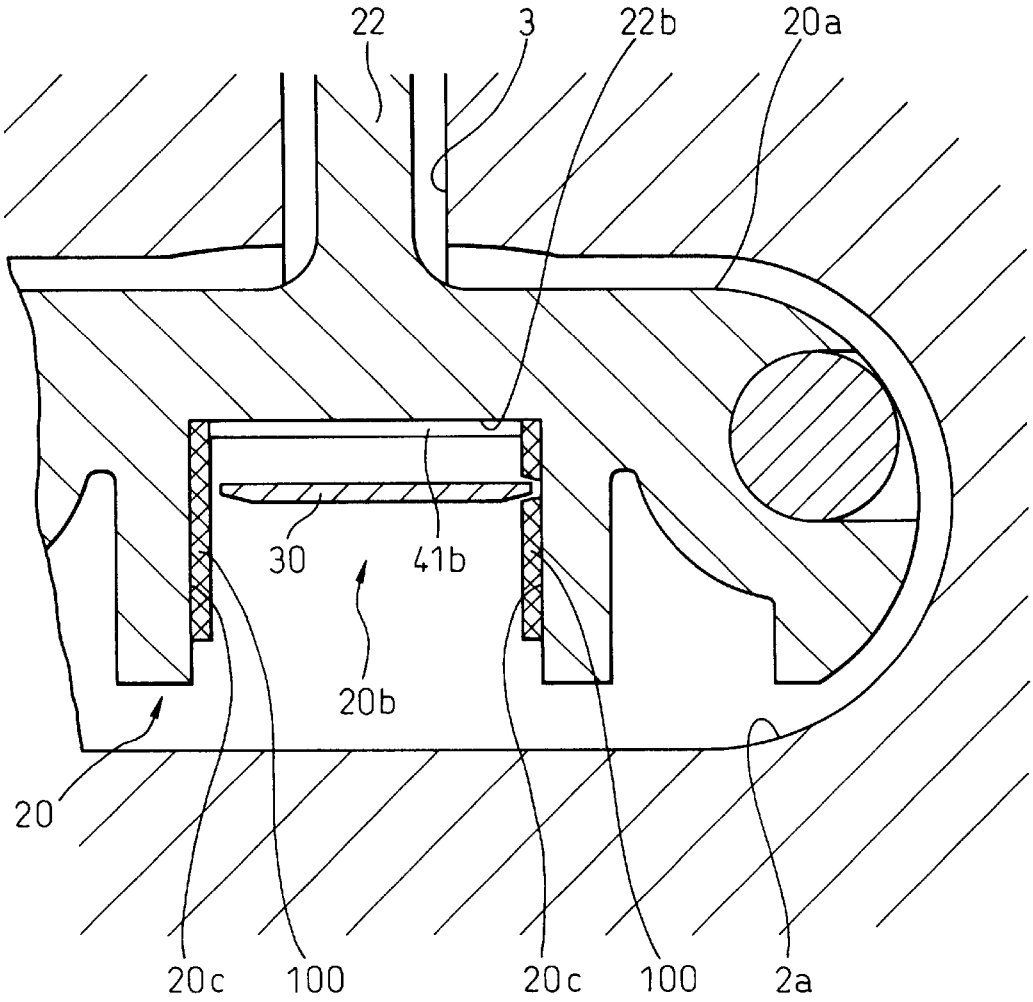
FIG. 4 is a drawing schematically illustrating the condition of the wearing plate when it worn.
Figure 5:
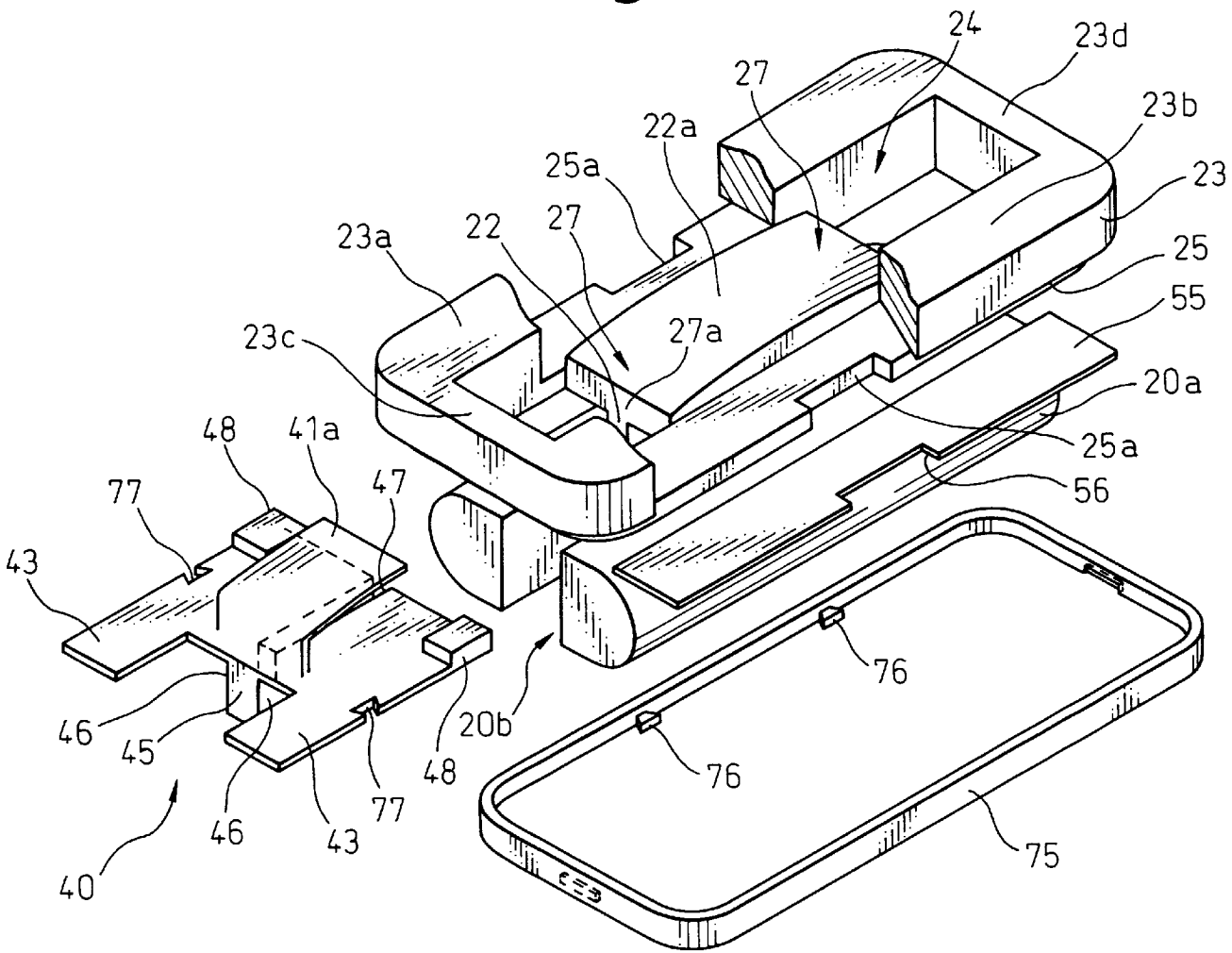
FIG. 5 is an exploded view showing the external moving body, the guide member and the adjusting shim.
Figure 6:
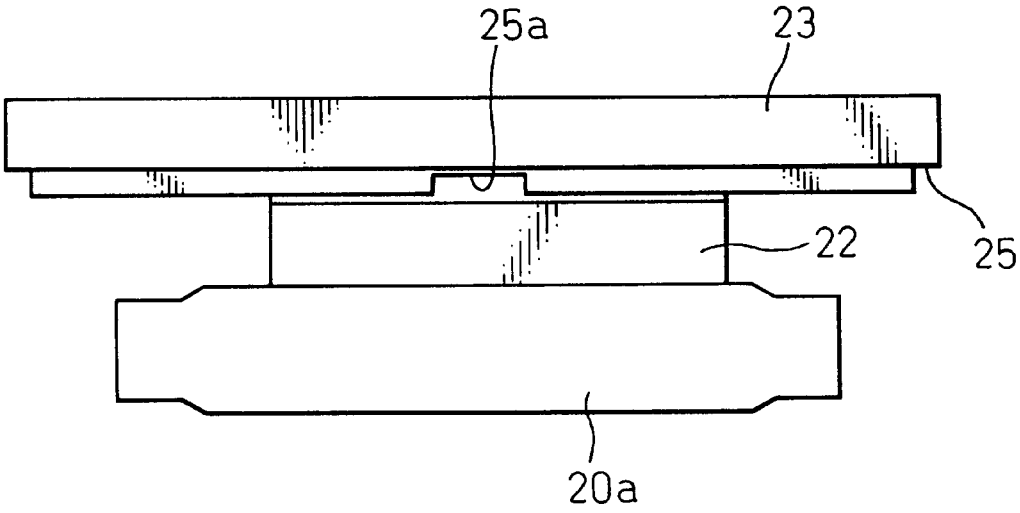
FIG. 6 is a side view of the internal moving body, the driving member and the external moving body formed as an integral one-piece element.

A stepped portion 25 for receiving a scraper is formed around the periphery of the bottom face of the piston mount 23 as shown in FIGS. 3, 4 and 5. Further, recesses 25*a* are formed on the bottom edges of the right and left side walls at the middle portions thereof. The recesses 25*a*, together with the projection 48 of the guide member 40 explained later, form a means for positioning the guide member 40.

The slider member 43 for contacting with and sliding on the outer wall surface (in FIGS. 1 through 3, upper face) 2*b* of the tube 2 is connected to the outer seal band guide 41*a* and the inner seal band 41*b*. The outer seal band guide 41*a* extends upward from the upper face of the slider member 43 as can be seen from FIG. 7. A sliding member 45, contacting with the side wall surfaces of the slit 3, is integrally formed on the lower face of the slider member 43. The sliding member 45 includes the sliding faces 46 for sliding on the side wall surfaces of the slit 3. As can be seen from FIG. 7, inner seal band guide 41*b* extends downward from the sliding member 45. A plurality of oil grooves 44 running in the transverse direction is formed on the lower face of the slider member 43. A slit 47 which fits the end of the driving member 22 is formed on the slider member 43. The slit 47 extends from the portion 42*a* from where the outer seal band guide 41*a* and the inner seal band guide 41*b* extend.

Figure 7:
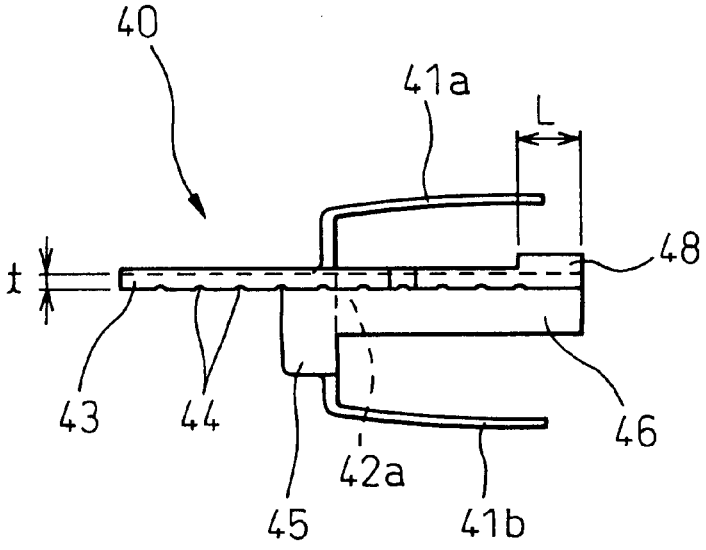
FIG. 7 is a side view of the guide member.
Figure 8:
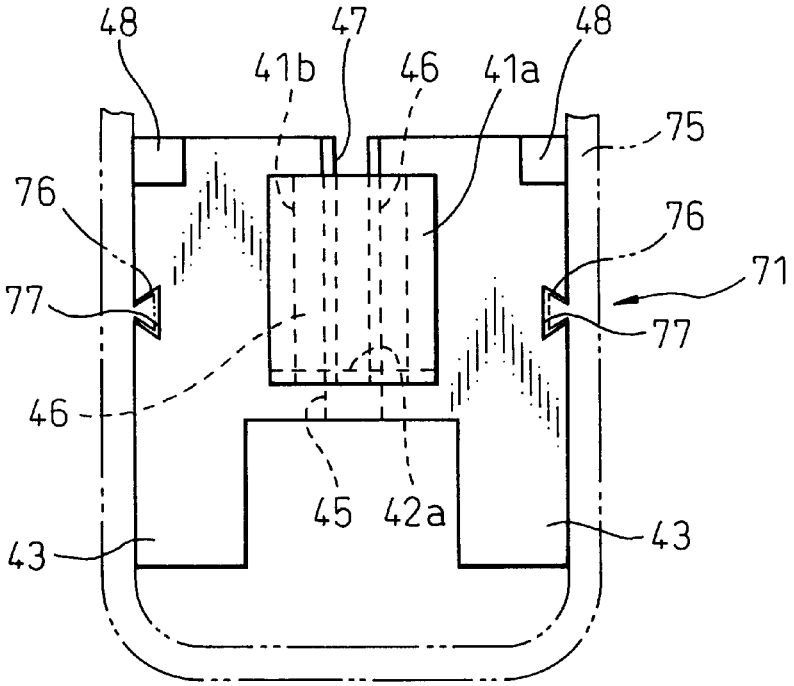
FIG. 8 is a plan view of the guide member in FIG. 7.
Figure 9:
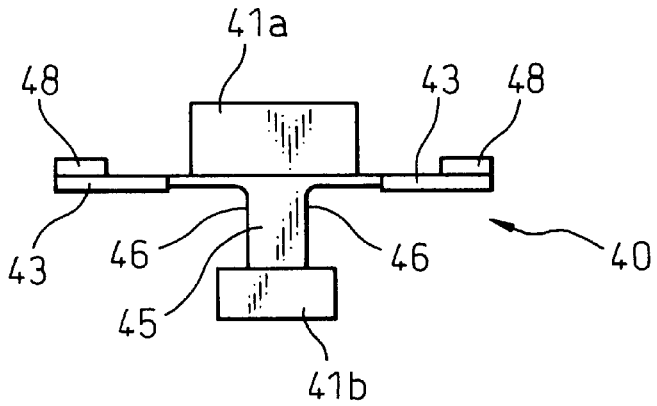
FIG. 9 is a front view of the guide member in FIG. 7.

FIGS. 7 through 9 illustrate one of the guide members 40, in this embodiment, which are attached to the fore and aft ends of the driving member 22. The guide member 40 is provided with an outer seal band guide 41*a* for guiding the outer seal band 31, an inner seal band guide 41*b* for guiding the inner seal band 30, and a slider member 43 for sliding on the outer wall surface of the tube 2.

The outer seal band guide 41*a* has a width matching the width of the outer seal band 31 and curves in such a manner that the upper face thereof forms a convex surface swelling upward and extending in the direction along the longitudinal axis of the tube. The inner seal band guide 41*b* has a width matching the width of the inner seal band 30 and is curved in such a manner that the lower face thereof forms a convex surface swelling downward and extending in the direction along the longitudinal axis of the tube.

Recesses 77 are formed on the slider member 43 at the middle of the longitudinal side thereof. The recesses 77 are used for fitting a scraper 75 to the piston mount 23, as explained later.

Projections 48 are provided at both sides of the longitudinal end of the slider member 43.

In order to attach the guide member 40 to the driving member 22, the driving member 22 is inserted into the slit 47 of the guide member 40 until the end of the slit 47 abuts the end face 27*a* of the driving member. In this condition, the inner and outer seal band guides 41*a* and 41*b* are resiliently expanded to opposite directions by the fitting portions 27 of the driving member 22 and the projections 48 engage with the recesses 25*a* on the bottom face of the driving member 22. Thus, the guide member 40 is firmly held on the driving member 22 by the resilient force of the band guides 41*a* and 41*b* which urge the guide member 40 in the direction away from the driving member 22 and a locking force by the engagement of the projections 48 with the recesses 25*a*. In this embodiment, the band guides 41*a*, 41*b*, the slit 47, the projections 48 and the recesses 25*a* form quick engaging means 49. The guide members 40 are fitted to the driving member at correct positions by the quick engaging means 49.

In this embodiment, the projections 48 on the slider member 43 have longitudinal lengths L (FIG. 7) at least equal to, and preferably larger than 1.5 times, the thickness t of the slider member 43 and widths similar to the lengths thereof. The dimensions of the projections 48 are determined in accordance with the magnitude of the friction force between the slider member 43 and the outer wall surface 2*b* of the tube 2. Namely, when the piston mount 23 moves, a force generated by the friction between the slider member 43 and the outer wall surface 2*b* is exerted on the slider member 43 and received by the engagement between the projections 48 and the recess 25*a*. Therefore, the sizes of the projections 48 are determined so that the sufficient strength and durability of the projections 48 against the cyclic force exerted on the projections 48 by the reciprocating travel of the piston mount 23 is ensured.

As explained before, the recess 20*b* formed on the bottom face of the piston portion 20*a* acts as an inner seal band channel groove through which the inner seal band 30 passes. On both side walls 20*c* of the inner seal band channel groove (the recess) 20*b*, abrasion plates 100 are attached. The abrasion plates 100 are thin plates made of abrasion resistant synthetic resin having a low friction coefficient and adhered to the side walls 20*c* by means of adhesive or a double-faced adhesive tape. The upper edge of the abrasion plate 100 is formed as an arc matching the curvature of the bottom face 22*b* of the inner seal band channel groove 20*b*. The abrasion plate 100 covers the substantial part of longitudinal length of the side wall 20*c* of the groove 20*b*. The distance between the surfaces of the abrasion plates 100 on both side walls 20*c* is set at a value the same as the width of the inner seal band 30 so that both side edges of the inner seal band 30 contact the surfaces of the abrasion plates 100 on both side walls. The longitudinal lengths of the abrasion plates 100 along the side walls 20*c* are selected in such a manner that the transverse displacement of the inner seal band 30 passing through the channel groove 20*b* is restricted by the contact between the edges of the inner seal band 30 and the abrasion plates 100 on both side walls 20*c*. In this embodiment, since the abrasion plates 100 are separate members from the driving member 22, the difference in the width of the inner seal band channel groove 20*b*, if any, due to the machining tolerance can be absorbed by adjusting the thickness of the abrasion plates 100 to an appropriate value.

As explained above, since the slider member 43, the band guides 41*a*, 41*b* and the sliding member 45 sliding on the side walls of the slit 3 are formed as an integral one-piece guide member 40 in this embodiment, the number of elements and steps of assembly of these elements are largely reduced. Further, since the guide member 40 can be attached to the moving body 18 easily and quickly by the quick engaging means 49, the efficiency of the work for attaching the guide member 40 to the moving body 18 is largely improved.

Figure 10:
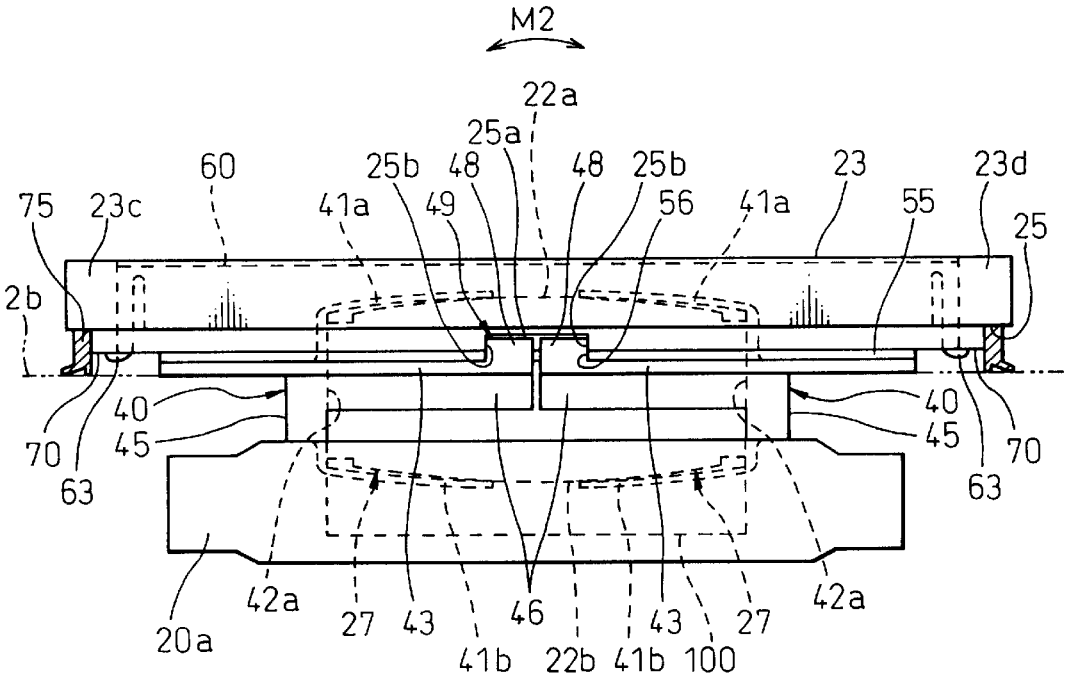
FIG. 10 is a side view showing the guide member and the adjusting shim attached to the one-piece element in FIG. 6.

As seen from FIGS. 5 and 10, an adjusting shim 55 is interposed between the upper face of the slider member 43 of the guide member 40 and the bottom face of the piston mount 23. The adjusting shim 55 has an elongated rectangular shape extending in the longitudinal direction so that one adjusting shim covers the slider members 43 of the guide members on both ends of the sliding body 18. The adjusting shim 55 is used for adjusting the contact between the slider member 43 and the outer wall surface 2*b* of the tube 2. Adjusting shim 55 is provided with a notch 56 at the position matching the position of the recess 25*a* of the piston mount 23. Therefore, when the guide member 40 is attached to the sliding body 18, the projection 48 of the slider member 43 engages with the notch 56 as well as with the recess 25*a*. Further, in this position, inner edge of the adjusting shim 55 abuts the outer side face of the band guide 41*a* at the position the band guide 41*a* is connected to the slider member 43. Therefore, the adjusting shim 55 is positioned in both longitudinal and transverse directions. In this embodiment, adjusting shims having various thicknesses are prepared and shims having suitable thickness are selected when the rodless cylinder is assembled.

The band cover 60 is formed by elastic synthetic resin having a low friction coefficient. The band cover 60 includes a top plate 61 having a width matching the width of the channel groove 24 and arm portions 62 disposed at both longitudinal ends of the top plate 61 (FIGS. 1 and 10). The lower end of the arm portion 62 is formed as a hook 63 facing outward. Further, the bottom end of the hook 63 forms a guide surface 64 for the outer seal band 31. Side walls 65 are formed on both transverse sides of the top plate 61, as shown in FIGS. 2 and 3. The distance between the walls 65 opposing each other is slightly larger than the width of the outer seal band 31, and the width of the band guide 41a for the outer seal band 31 is smaller than the distance between the side walls 65. A plurality of ribs 66 extending longitudinal direction are formed on the inner face of the top plate 61 at the portion between the side walls 65. In this embodiment, the lower edges of the ribs 66 form a concave guide surface 67 facing downward for guiding the upper face of the outer seal band 31, and the inner faces of the side walls 65 form transverse guide surfaces 68 for guiding the edges of the outer seal band 31.

Engaging portions 70 which engage with the hooks 63 of the arm portions 62 are formed at lower edges of the fore and aft walls 23*c*, 23*d* of the piston mount 23.

A scraper 75 having double lips is attached to the stepped portion 25 of the piston mount 23 so that it surrounds the peripheries of the fore and aft guide members 40, slider member 43 and the adjusting shim 55 (FIG. 5) and that the outer periphery of the scraper 75 is exposed to the outside. A plurality of inward projections 76 are disposed on the inner periphery of the scraper 75 at the middle of the longitudinal side thereof (FIG. 5). The positions of the projections 76 matches the positions of the recesses 77 on the guide members 40 when the scraper 75 is attached to the stepped portion 25 of the piston mount 23. Therefore, by inserting the projections 76 into the recesses 77, the scraper 75 is positioned and held on the piston mount 23. The recesses 77 and the projections 76 form a fitting means 71 for fitting the scraper 75 to the piston mount 23.

The outer seal band 31 and the inner seal band 30 are disposed between the end caps 10 on both ends of the tube 2 along the entire length of the slit 3. The outer seal band 31 passes the upper face of the driving member 22, and the inner seal band passes the lower face of the driving member 22. The outer and the inner seal bands 30, 31 are thin flexible bands made of, for example, a magnetic metal such as steel. The seal bands 30 and 31 have widths wider than the slit 3. Both ends of the seal bands 30, 31 are fitted to the end caps 10 by fitting pins 39 inserted into fitting holes 38 formed on the end caps 10. Cover members 79 are attached to the end caps 10 in order to cover the outer ends of the fitting pins 39 (FIG. 1). The cover members 79 prevent the fitting pins 39 from falling out from the end caps 10.

In this embodiment, magnets 80 are disposed on both sides of the slit 3 along the entire length thereof. Therefore, the seal bands 30 and 31 are attracted to the magnets 80 along the entire length thereof except the portions thereof passing through the driving member 22. The inner seal band 30 adheres to and seals the slit 3 by the pressure of the fluid in the cylinder chamber 6 and the attracting force of the magnets 80. The outer seal band 31 also adheres to and seals the slit 3 by the attracting force of the magnets 80.

In this embodiment, a pressurized fluid is introduced into one of the cylinder chambers 6A and 6B via inlet/outlet ports 15 on the end caps 10 (FIG. 1), inlet/outlet passages 81 and central ports 83 on internal dampers 82. When a pressurized fluid is introduced into one of the cylinder chambers 6A and 6B, the piston 20, i.e., the external moving body 26 moves along the longitudinal axis of the tube 2 while the inner and outer seal bands 30, 31 close the slit 3. The internal dampers 82 abut the piston 20 at its stroke ends to absorb the kinetic energy of the piston 20. Further, external dampers 84 are provided on the tube 2 for the same purpose.

When the piston 20 moves, since both longitudinal ends of the inner seal band 30 are fixed on the end caps 10 and the transverse position of the middle portion of the inner seal band 30 between both ends is restricted by the abrasion plates 100 of the inner seal band channel groove 20*b* of the piston 20, the displacement of the inner seal band 30 in the transverse direction relative to the slit 3 is prevented. Therefore, leakage of the fluid in the cylinder and "stick and slip" of the piston are prevented from occurring.

In this embodiment, the band cover prevents the outer seal band 31 from contacting with the side walls of the recess 24 of the external moving body 26. Further, the band guides 41*a* and 41*b* of the fore and aft guide members 40 prevent the lower face of the outer seal band 31 and the upper face of the inner seal band 30 from contacting the top face 22*a* of the driving member 22 and the bottom face 22*b* of the seal band guide recess 20*b*. Further, the abrasion plates 100 attached to the side walls 20*c* of the inner seal band channel groove 20*b* prevent direct contact between both longitudinal edges of the inner seal band 30 and the side walls 20*c*. Therefore, according to the present embodiment, dust is not generated by the wearing of metal parts even though the piston portion 20*a*, driving member 22 and the piston mount 23 are formed as solid metal one-piece construction. Therefore, shortening of the service life of the seal bands 30 and 31 due to dust attaching thereto does not occur.

Further, in some cases, the abrasion plates 100 may be cut in two pieces due to wear caused by the contact with the edges of the inner seal band 30 as shown in FIG. 4. However, even in such cases, since the abrasion plates 100 are adhered to the side walls 20*c* by adhesive or double-faced adhesive tape, the pieces of the abrasion plates 100 do not come apart from surface of the side walls 20*c*. Therefore, no foreign matter which hampers the movement of the external moving body will be produced even if wear of the abrasion plate 100 occurs.

When the moving body 18 moves in one direction, force due to the friction between the slider member 43 and the outer wall surface 2*b* of the tube is exerted on the slider member 43 in the direction opposite to the direction of the movement of the moving body 18. In other words, the slider member 43 is dragged by the moving body 18 through the engagement between the projections 48 of the slider member 43 and the recess 25*a* of the piston mount 23 against the friction force. Therefore, force is repeatedly exerted on the projections 48 when the moving body 18 moves back and forth and, in some cases, the breakage of the projections may occur. It has been found that the possibility of the breakage of the projections 48 due to this drag force becomes low if the longitudinal length of the projection (L in FIG. 7) is larger than the thickness t of the slider member 43. The possibility of the breakage is remarkably lower when the longitudinal length of the projection is larger than 1.5 times the thickness of the slider member.

Further, a plurality of oil grooves 44 running in the transverse direction are formed on the lower face of the slider member 43 in this embodiment. By applying lubricant (such as grease) to these oil grooves 44, the friction between the slider member 43 and the outer wall surface 2*b* of the tube 2 can be lowered to ensure a smooth movement of the slider member 43. These oil grooves 44 are not formed on the lower face of the slider member 43 at the portion beneath the projection 48 in this embodiment. Therefore, the strength of the projection 48 is not lowered by the oil grooves 44.

Further, as shown in FIG. 3, when a moment M1 is exerted on the piston mount 23 in the plane perpendicular to the longitudinal axis, this moment M1 is cancelled by the reaction force F1 perpendicular to the outer wall surface 2*b*. In this case, the force F1 is received by the outer wall surface 2*b*. Therefore, substantially no bending moment is exerted on the driving member 22. This is also true in the case where a moment M2 is exerted on the piston mount 23 in the plane including the longitudinal axis of the tube 2 (FIG. 10).

Figure 11:
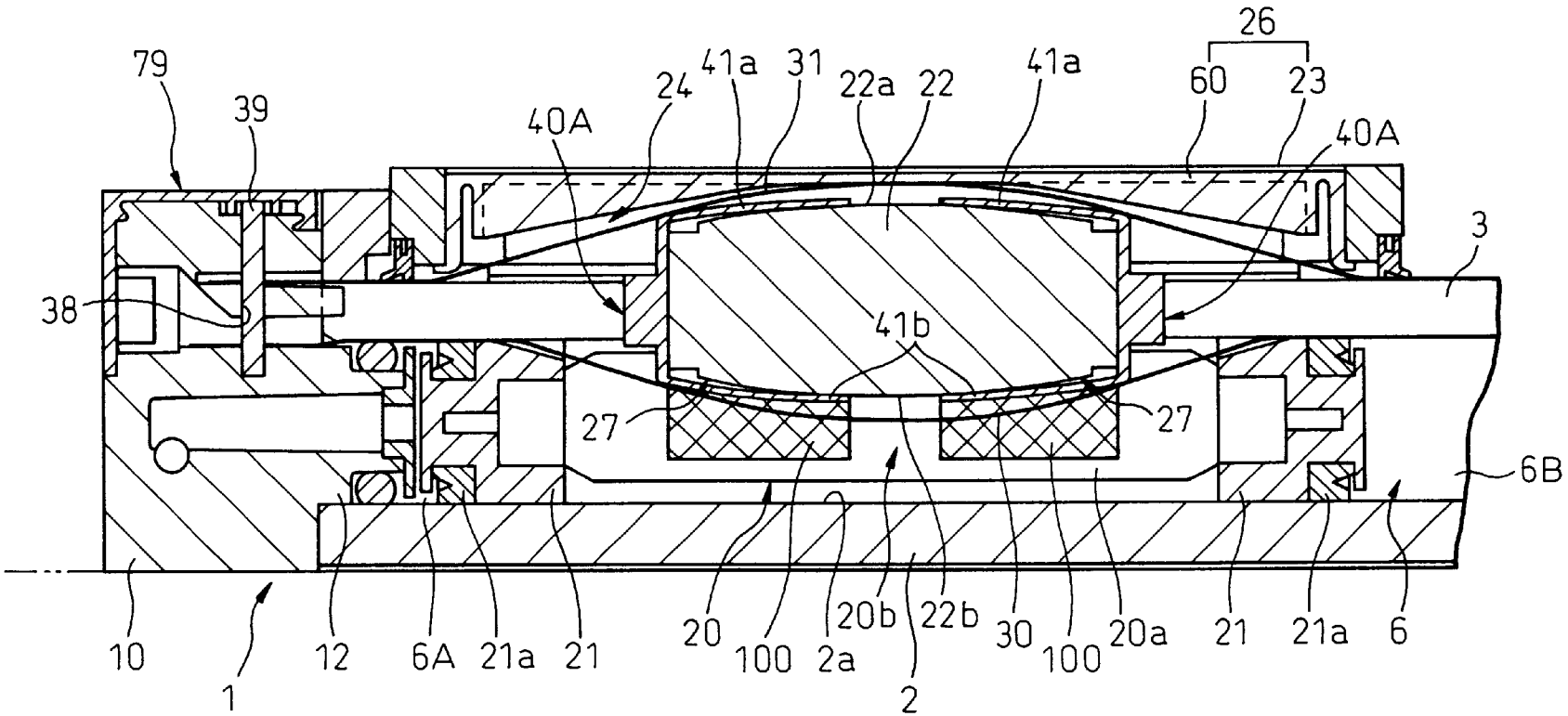
FIG. 11 is a longitudinal sectional view of a rodless cylinder according to another embodiment of the present invention.
Figure 12:
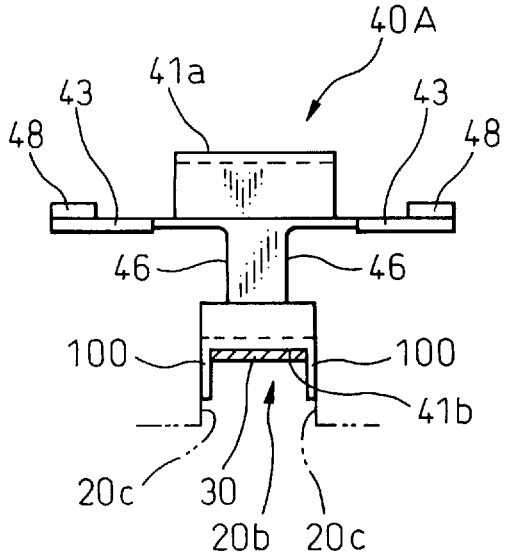
FIG. 12 is a front view of the guide member in FIG. 11.

FIGS. 11 and 12 show another embodiment of the present invention. In this embodiment, the abrasion plates 100 are formed as integral parts with the inner seal band guide 41*b*. In this case, as shown in FIG. 12, the abrasion plates 100 extend downward from both side edges of the inner seal band guide 41*b*. In the longitudinal direction, the abrasion plates 100 in this embodiment extend to near the central portion of the recess (channel groove) 20*b*. According to the present embodiment, since the abrasion plates 100 can be fitted to the recess 20*b* together with the band guide 41*b*, the number of steps for assembling the rodless cylinder can be significantly reduced.

Figure 13:
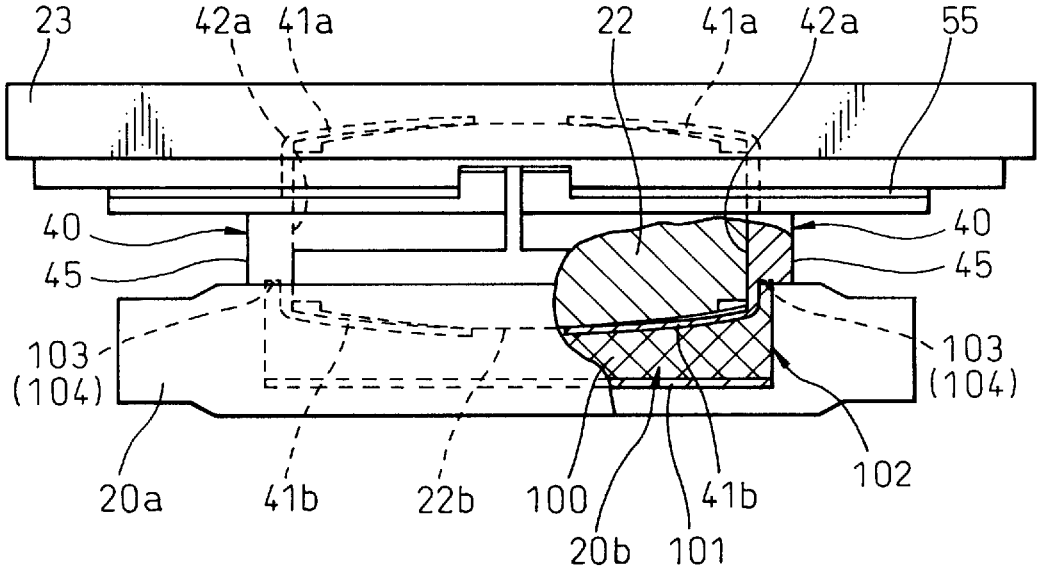
FIG. 13 is a side view showing the guide member and the adjusting shim according an embodiment of the present invention which is different from those in FIGS. 1 and 11.
Figure 14:
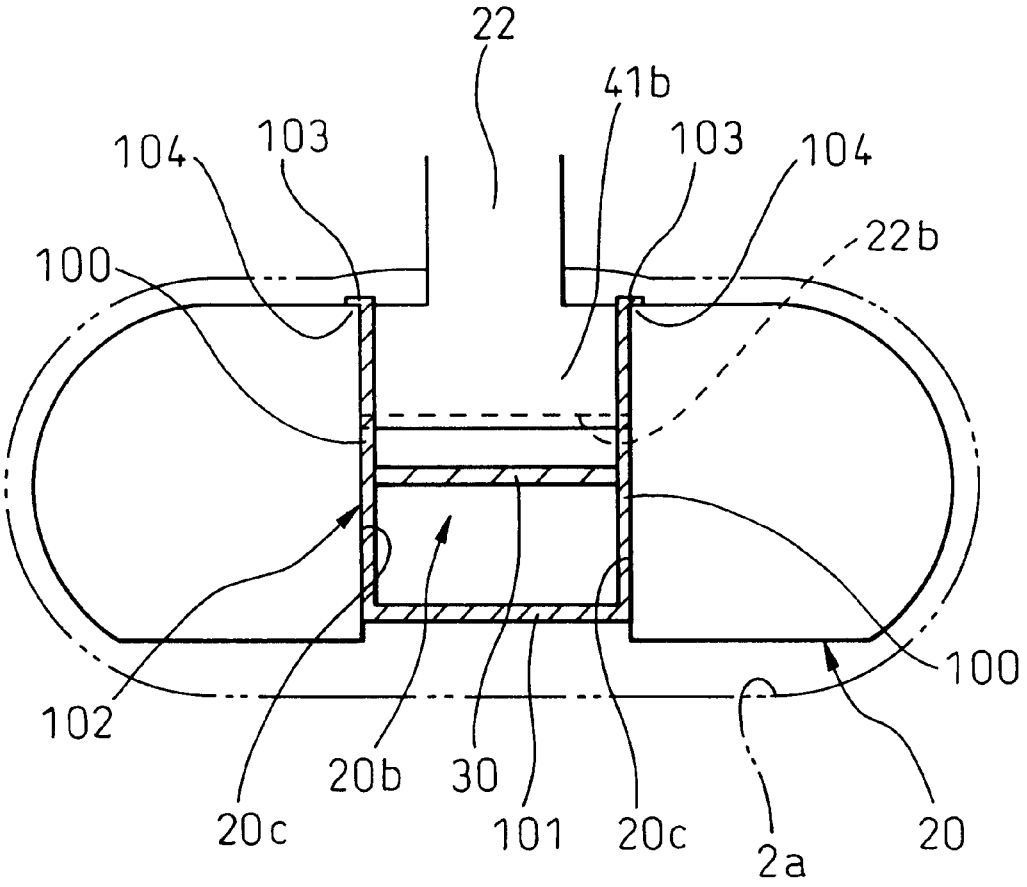
FIG. 14 is an enlarged front view of the guide member in FIG. 13.

FIGS. 13 and 14 show an embodiment different from those explained above. In this embodiment, a pair of abrasion plates 100 are interconnected by a connecting member 101 at the lower ends thereof and form an integral abrasion piece 102 having a U-shaped cross section. The abrasion piece 102 is made of resilient synthetic resin and is provided with engaging hooks 103 on both abrasion plates 100 on the top edge at both ends thereof (FIG. 14). The abrasion piece 102 is fitted into the channel groove 20*b* by resiliently engaging the hooks 103 with the upper edges 104 of the side walls 20*c* of the channel groove 20*b*. According to the present embodiment, the abrasion plates 100 can be fitted to and removed from the channel groove 20*b* by a simple and easy operation.

Figure 15:
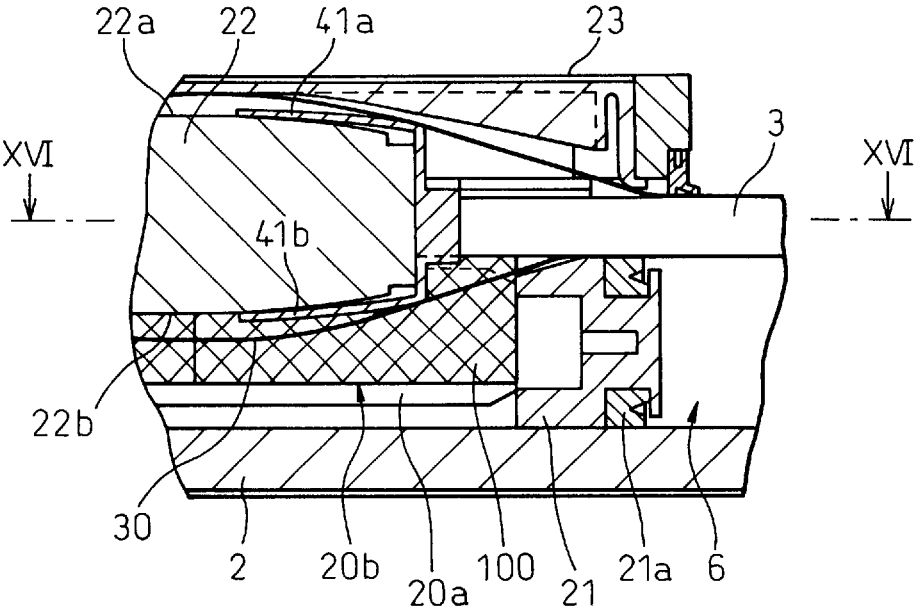
FIG. 15 is a longitudinal sectional view of the piston according to an embodiment of the present invention which is different from those in FIGS. 1, 11 and 13.
Figure 16:
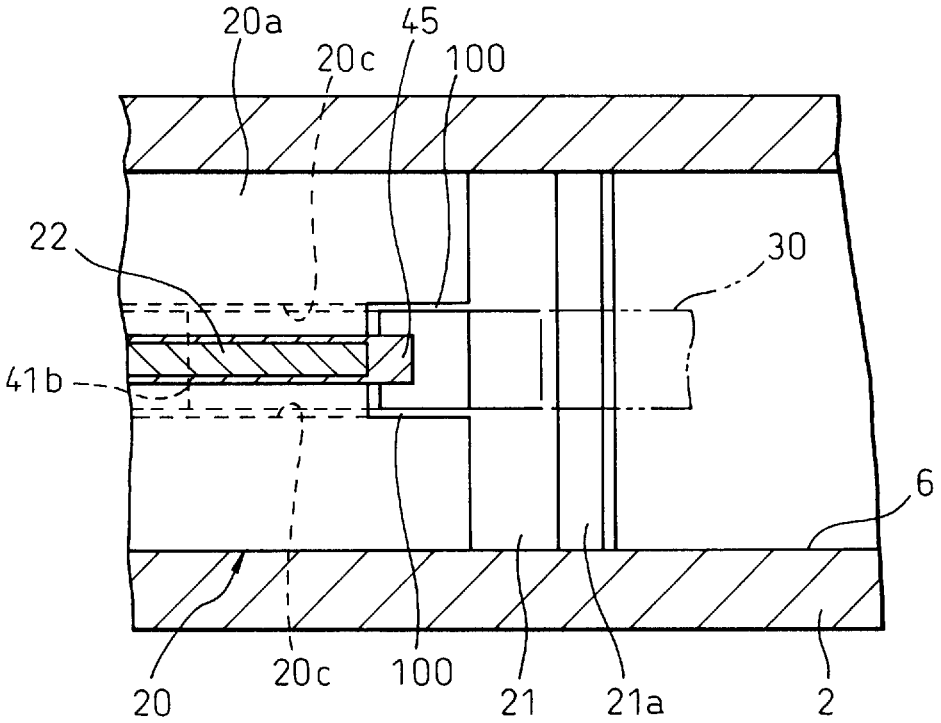
FIG. 16 is a sectional view taken along the line XVI—XVI in FIG. 15.

FIGS. 15 and 16 show another embodiment of the present invention. In this embodiment, the abrasion plates 100 are formed as parts integral with the piston ends 21 which are disposed at both ends of the piston portion 20*a*. The abrasion plates 100 extend inwardly from the piston ends 21 along the side walls 20*c* of the channel groove 20*b*. The abrasion plates 100 extending from both piston ends 21 extend in a longitudinal direction to the central portion of the channel groove 20*b* where the abrasion plates 100 from both piston ends meet and form continuous abrasion members covering the entire length of the side walls.

What is claimed is:

1. A rodless power cylinder comprising:

a tube provided with a bore and a slit which penetrates the wall of the tube and extends in parallel with the longitudinal axis of the tube;

an internal moving body disposed in the bore of the tube and movable therein along the direction of the longitudinal axis of the tube;

an external moving body disposed outside of the tube and coupled to the piston by a driving member extending through the slit so that the external moving body moves with the internal moving body along the slit; and an inner seal band having flat faces on both sides and extending along the slit to cover the slit from the inside of the bore, both longitudinal end portions of said inner seal band being restrained in movement with respect to the tube, and the middle portion thereof passing through a channel groove formed on the internal moving body;

wherein separate abrasion members are provided on the side walls of the channel groove in such a manner that the movement of the inner seal band in the transverse direction is restrained by the restrained ends of the inner seal band and the contact between the longitudinal edges of the inner seal band and said abrasion members.

2. A rodless power cylinder as set forth in claim 1, wherein the longitudinal length of the abrasion members is determined in such a manner that a displacement of the portions of the inner seal band between the abrasion members and both longitudinal ends in the transverse direction does not occur.

3. A rodless cylinder as set forth in claim 1, wherein the abrasion member is made of a thin plate adhered to the side wall of the channel groove.

4. A rodless cylinder as set forth in claim 2, wherein the abrasion member is made of a thin plate adhered to the side wall of the channel groove.

5. A rodless cylinder as set forth in claim 1, wherein band guides are provided on the internal moving body at both longitudinal ends of the channel groove, and wherein the abrasion members are formed as integral parts of the band guides and extend from both transverse edges of the band guides.

6. A rodless cylinder as set forth in claim 2, wherein band guides are provided on the internal moving body at both longitudinal ends of the channel groove, and wherein the abrasion members are formed as integral parts of the band guides and extend from both transverse edges of the band guides.

7. A rodless cylinder as set forth in claim 5, wherein the band guides are formed as an integral part of a slider member which is fixed to the external moving body by engaging projections formed on the slider member with recesses formed on the external moving body and, wherein the length of the projection along the direction of the tube axis is larger than the thickness of the slider member.

8. A rodless cylinder as set forth in claim 6, wherein the band guides are formed as an integral part of a slider member which is fixed to the external moving body by engaging projections formed on the slider member with recesses formed on the external moving body and, wherein the length of the projection along the direction of the tube axis is larger than the thickness of the slider member.

9. A rodless cylinder as set forth in claim 7, wherein a plurality of oil grooves running in the transverse direction are provided on the face sliding on the outer wall of the tube except for the portions at the back side of the projections.

10. A rodless cylinder as set forth in claim 8, wherein a plurality of oil grooves running in the transverse direction are provided on the face sliding on the outer wall of the tube except for the portions at the back side of the projections.

11. A rodless cylinder as set forth in claim 1, wherein an abrasion piece is formed by connecting a pair of the abrasion members opposing each other and made of thin plates by a connecting member so that the cross section of the abrasion piece forms a U-shape, said abrasion piece is provided with fitting portions which allow removable fitting of the abrasion piece into the channel groove in such a manner that the side walls of the channel groove are covered by the thin plate abrasion member when the abrasion piece is fitted into the channel groove.

12. A rodless cylinder as set forth in claim 2, wherein an abrasion piece is formed by connecting a pair of the abrasion members opposing each other and made of thin plates by a connecting member so that the cross section of the abrasion piece forms a U-shape, said abrasion piece is provided with fitting portions which allow removable fitting of the abrasion piece into the channel groove in such a manner that the side walls of the channel groove are covered by the thin plate abrasion member when the abrasion piece is fitted into the channel groove.

13. A rodless cylinder as set forth in claim 1, wherein the internal moving body comprises a piston portion and piston ends disposed on both longitudinal ends thereof, and wherein a pair of the abrasion members project from each piston ends into the channel groove disposed between both piston ends.

14. A rodless cylinder as set forth in claim 2, wherein the internal moving body comprises a piston portion and piston ends disposed on both longitudinal ends thereof, and wherein a pair of the abrasion members project from each piston end into the channel groove disposed between both piston ends.

15. A rodless cylinder as set forth in claim 1, wherein the guide member is made of synthetic resin having a low friction coefficient.

* * * * *